US005841411A

United States Patent [19]

Francis

[11] Patent Number: 5,841,411

[45] Date of Patent: Nov. 24, 1998

[54] ACTIVE MATRIX LIQUID CRYSTAL DISPLAY DEVICE WITH CROSS-TALK COMPENSATION OF DATA SIGNALS

[75] Inventor: Andrew M. Francis, Reigate, England

[73] Assignee: U.S. Philips Corporation, New York, N.Y.

[21] Appl. No.: 856,477

[22] Filed: May 14, 1997

[30] Foreign Application Priority Data

May 17, 1996 [GB] United Kingdom ..... 9610381
Mar. 19, 1997 [GB] United Kingdom ..... 9705703

[51] Int. Cl.[6] ..... G09G 3/20; G09G 3/36

[52] U.S. Cl. ..... 345/58; 345/92

[58] Field of Search ..... 345/58, 92, 94, 345/101, 100; 348/792

[56] References Cited

U.S. PATENT DOCUMENTS

| | | | |
|---|---|---|---|
| 4,635,127 | 1/1987 | Togashi | 348/792 |
| 4,845,482 | 7/1989 | Howard et al. | 340/805 |
| 5,175,535 | 12/1992 | Yamazaki et al. | 345/58 |
| 5,414,440 | 5/1995 | Ilcisin et al. | 345/58 |
| 5,434,588 | 7/1995 | Parker | 345/58 |
| 5,471,228 | 11/1995 | Ilcisin et al. | 345/58 |
| 5,473,338 | 12/1995 | Prince et al. | 345/58 |
| 5,583,528 | 12/1996 | Ebihara | 345/58 |
| 5,625,373 | 4/1997 | Johnson | 345/58 |
| 5,646,643 | 7/1997 | Hirai et al. | 345/58 |
| 5,677,705 | 10/1997 | Shimura et al. | 345/100 |

FOREIGN PATENT DOCUMENTS

| | | | |
|---|---|---|---|
| 0628944A1 | 12/1994 | European Pat. Off. | G09G 3/36 |
| WO9616393 | 5/1996 | WIPO | G09G 3/36 |

*Primary Examiner*—Jeffery Brier
*Assistant Examiner*—David L. Lewis
*Attorney, Agent, or Firm*—F. Brice Faller

[57] ABSTRACT

An active matrix display device having an array of LC picture elements (12), with associated switching means (25), addressed in row sequential fashion via sets of row and column address lines (14, 16) includes in its drive circuit a data signal adjustment circuit (40) which adjusts data signals before application to the column lines (16) so as to compensate for anticipated effects of vertical and lateral forms of cross-talk due to stray capacitive couplings in the picture element array. A correction value for a picture element data signal is derived in the adjustment circuit (40) according to the values of data signals intended over a subsequent field period for other picture elements in the same column and one or both adjacent columns, and the relevant capacitive coupling factors. The display device may be of the type using TFTs, TFDs or a plasma-addressed display device.

8 Claims, 4 Drawing Sheets

ACTIVE MATRIX LIQUID CRYSTAL DISPLAY DEVICE WITH CROSS-TALK COMPENSATION OF DATA SIGNALS

BACKGROUND OF THE INVENTION

This invention relates to an active matrix display device having a row and column array of picture elements comprising rows of liquid crystal display elements with switching means coupled thereto, sets of row and column address lines coupled to the rows and columns of picture elements, and a drive circuit for applying data signals to the column address lines and for scanning the row address lines to select each row of picture elements in sequence so as to drive the display elements of a selected row in accordance with the data signals applied to the associated column address lines.

Display devices of the above kind are well known. Commonly, the switching means used in such display devices comprise TFTs (thin film transistors). An example of a TFT type display device is described in U.S. Pat. No. 4,845,482. In such a display device, sets of row and column address lines are carried on one of two spaced substrates together with a display element electrode and a TFT adjacent each intersection between the sets of address lines, while the other substrate carries a common electrode. Each TFT is connected to its associated display element electrode and respective row and column address lines. The driving circuit connected to the row and the column address lines applies a selection signal to each row line in turn and data signals to the column lines whereby the display elements of a selected row are charged via their respective switching device to a level dependent on the value of the data signal on their associated column line so as to produce a required display output effect. The rows of picture elements are driven individually in turn during respective row address periods in this manner so as to build up a display picture over one field period, the picture elements being repeatedly addressed in similar manner in successive field periods. Such display devices are suitable for datagraphic display purposes or for video pictures, the data signals being derived in this case by sampling an input video, e.g. TV, signal.

A problem with these display devices is that of vertical cross-talk which is caused by parasitic or stray capacitive effects in each picture element circuit, for example between a column address line and a display element electrode of a display element associated with that column line and as a result of the self capacitance of the TFT whose source and drain terminals are connected to the column line and the display element electrode respectively. As a result of such capacitances, data voltage signals present on the column lines and intended for use in driving picture elements associated with that column line as they are selected are coupled to the non-selected picture elements in the column causing vertical cross-talk and affecting the outputs of supposedly isolated display elements. This vertical cross-talk can be regarded as the dependence of the RMS voltage on a given display element upon the data signals intended for other display elements in the same column. Such a cross-talk problem is discussed in U.S. Pat. No. 4,845,482 which describes a method for reducing the effects that involves applying a gating signal to a row line for a time shorter than the standard row address period, applying the data signal to the column line during this time, and applying a compensation signal to the column line during the remainder of the period, the compensation signal being a function of the complement of the data signal, so as to reduce any cross-talk produced in other picture elements connected to the column line as a result of that data signal. However, because the row address period is shortened the display elements have to be charged in less time than normal and this requires using higher gating voltages which has a number of disadvantages including an increase in ageing effects on the TFTs as well as the need for comparatively high voltage row drive circuit. The resistance of the row lines then also becomes a more significant factor as this can lead to degradation of the gating signals.

The magnitude of the vertical cross-talk effect is dependent on the method of driving the display device. If field inversion is used, the effect can be considerable. The effect can be reduced to some extent by using a line inversion drive scheme, intended to eliminate flicker, in which the data signals applied to a column line are inverted every row as a result of which the coupled column voltages have alternating positive and negative values thereby making the overall coupled RMS voltage closer to zero and reducing the amount of vertical cross-talk. However, a problem can occur when using single line inversion in color display devices that use the delta color filter pattern where each column line is connected to picture elements having only two colors. In this case the data signal for large areas of a primary color like red is the same as that for a plain black or white area with field inversion and large amounts of cross-talk can occur. Also, in computer datagraphic displays, the nature of some video patterns can cancel the inversion procedure, making vertical cross-talk more noticeable.

In PCT/WO 96/16393 there is described an active matrix display device of the aforementioned kind wherein the drive circuit includes a data signal adjustment circuit for compensating for the effects of vertical cross-talk in the display panel due to capacitive coupling between the display elements and their associated column address lines, which adjustment circuit has an input to which data signals are applied and adjusts an input data signal for a picture element according to a cross-talk compensation value derived from the data signals intended for other picture elements connected to the same column address line as that picture element in the period until the picture element is next addressed, with the adjusted data signals being supplied to the column address lines for driving the picture elements. Thus, rather than trying simply to reduce the amount of vertical cross-talk due to the data signals on the column address lines, the effects of vertical cross-talk through column coupling phenomenon are compensated by altering the data signals intended for a column of picture elements before they are applied to the picture elements to allow for the expected column coupling due to the data signals for those picture elements so that after their application to the appropriate picture elements the effect of vertical cross-talk on an individual picture element leads to the display element having substantially the intended, correct, voltage, and consequently to the display element producing an output which is closer to the intended output as determined by the value of the data signal before such adjustment. The adjustment circuit in effect predicts the error in the RMS display element voltage due to such cross-talk and applies a correction to the data signals which is substantially equal and opposite to the predicted error. Using this technique the picture element address periods are not reduced, and hence the problems caused by previous approaches requiring address period reductions are avoided. It also offers a further significant advantage. Previously, the consequences of vertical cross-talk have imposed a limitation on the size of the picture elements. As picture element sizes are reduced, for example in order to provide higher density arrays, the column coupling factor increases and vertical cross-talk becomes worse. There is a limit where the known methods cannot reduce cross-talk sufficiently. With this technique, however, such picture element size limitations can be overcome.

OBJECTS AND SUMMARY OF THE INVENTION

It is an object of the present invention to provide an active matrix display device in which the capability of reducing unwanted display effects due to cross-talk is improved still further.

According to the present invention, the drive circuit includes a data signal adjustment circuit for adjusting input data signals prior to their application to the column address lines according to a cross-talk compensation value and supplying the adjusted data signals to the column address lines for use in driving the display elements to compensate for cross-talk effects due to stray capacitive couplings with the display elements. The adjustment circuit is arranged to derive the cross-talk compensation value for a picture element from the data signals intended to be applied in the period until that picture element is next selected to the column address line associated with that picture element and at least one of the column address lines associated with the adjacent columns of picture elements.

With this display device then not only are the anticipated effects of vertical cross-talk taken into consideration but also the effects of a lateral form of cross-talk due to unwanted couplings between a display element and one or both of the column lines used for driving adjacent columns of picture elements. In active matrix display devices such as those using TFTs, the sets of row and column address lines are arranged on one plate, together with the TFTs and the display element electrodes, so as to extend in gaps between, respectively, adjacent rows and adjacent columns of display element electrodes. Consequently, for a picture element in a given column the physical layout of the display element electrode and the column address lines can lead to capacitive coupling between the display element electrode and a column address line next to that associated with the picture element. By taking into account the data signals for this adjacent column address line as well as those on the associated column address line the anticipated effects of those data signals in addition to the effects of the data signals on the associated column address line conveniently are amalgamated in the compensation value calculated in the adjustment circuit and used to adjust the data signal for the given picture element to counteract the predicted effects from both column address lines. As a result, further improvement to reducing the effects of cross-talk is obtained.

Although, for certain kinds of display applications, adequate improvement may be obtained by compensating data signals in accordance with the values of the data signals intended for some, but not all, of the picture elements associated with the aforementioned column address conductors, preferably the modification of the data signals is accomplished taking into account the data signals intended for substantially all the other picture elements associated with those column address lines for optimum results. The reduction in cross-talk as a result of the invention is found to vary approximately linearly with the number of data signal voltages to be applied to the column address conductors taken into account.

To provide effective compensation in most display situations then the adjustment made to an input data signal is preferably made according to the values of the input data signals for other picture elements in the same column and corresponding picture elements in at least one of the adjacent columns during the field period which follows the addressing of the particular picture element with that input data signal. In a preferred embodiment, therefore, the input data signal is held in a store in the adjusting circuit for a field period and then adjusted according to a compensation value which is determined from the values of input data signals for picture elements in the same column and the adjacent column, or columns, that are held in the store during that field period. The store is required because there is a need to know the actual data signals, as determined by the applied video signals, which are intended for those other picture elements ahead of the addressing of a picture element with the input data signal concerned. The intended data signals used in the derivation of the compensation value are then the actual data signals according to the applied video signal, to be used. In practice, a field store may be used to hold the data signals.

In certain circumstances and particularly where the display device is used to a large extent for displaying principally stationary images or images which contain stationary parts a simpler approach is possible. In another embodiment, therefore, the data signal adjustment circuit adjusts an input data signal according to a cross-talk compensation value that is derived from the values of data signals input during the immediately preceding field period. Thus, the intended data signals used in the derivation of the compensation value are not the actual input data signals for other picture elements in the same and adjacent columns but instead are postulated data signals and are predicted on the basis the data signals for a following field period will, apart from, for example, a change of sign in the case of field inversion being used, remain the same for a stationary image. In other words, the actual, future, data signals voltages can be assumed to be simply the negative of the current data signal voltages. The current data signal values can be used to predict the future data signal values. The need to provide a field store is then avoided. The data signal predictions will, of course, be incorrect in the event that the input data signals are changed to provide a different display image. However, the effects of such a change between two display images before the data signal adjustments are corrected can be limited to two fields which is unlikely to be noticeable. Preferably, however, in order to accommodate a situation where continuous motion is to be displayed, the data signal adjustment circuit is arranged so as to compare values dependent on the input data signals for a column in consecutive fields and to disable the adjustment to the input data signal for a column in the event that the values in consecutive fields differ by a predetermined amount. Thus, the input data signals are used to address the picture elements of the column concerned without adjustment for cross-talk compensation. Although the effects of cross-talk will then be present, they are likely to be less visible than the effects caused if adjustment, on the basis of incorrect, predicted, data signals, were to continue.

The data signal is preferably adjusted substantially according to a compensating factor which is determined by the intended data signals for the other picture elements connected to the same and adjacent column address line or lines, the intended display element voltage, and capacitive coupling factors for a picture element circuit. These coupling factors would be dependent on, for example, the display element capacitance and stray capacitance between the display element and address lines. In the case of the data signals being derived from an applied video, e.g. TV, signal, in which successive fields are separated by a field blanking interval, then because the blanking interval can be a significant part of the field period it may also be taken into account in the derivation of the adjusted data signals.

For a TFT type display device, the compensation value is preferably derived according to the data signals intended for picture elements in the same column as the picture element concerned and the picture elements in the adjacent column whose associated address line extends alongside that picture element.

In addition to display devices using TFTs as the switching means, the invention is similarly applicable to plasma-addressed display devices (PALC display devices) which use plasma channels as the effective switching means for a row of display elements. In this case, the cross-talk compensation value for a picture element is preferably derived according to the data signals intended for picture elements in the same column as the picture element concerned and the picture elements in the adjacent two columns, i.e. to either side of that column. The invention is applicable also to active matrix display devices in which the switching means comprise two terminal non-linear switching devices, such as thin film diodes. In these other types of display devices vertical cross-talk can occur due to the coupling of data signals present on a column line to a display element associated with that column line, as for example is described in previously mentioned PCT WO96/16393 in relation to display devices using two-terminal switching devices. In addition, however, lateral type cross-talk can occur due to data signals on a column line adjacent that associated with the display element as a result of stray capacitive couplings between a display element and an adjacent column line, either directly or indirectly via an intermediate capacitance depending on the form of the display device. The invention can therefore be used beneficially to reduce the extent of unwanted cross-talk effects due to these couplings.

BRIEF DESCRIPTION OF THE DRAWINGS

It should be understood that the same reference numerals are used throughout to denote the same or similar parts.

DESCRIPTION OF THE PREFERRED EMBODIMENTS

Figure 1:
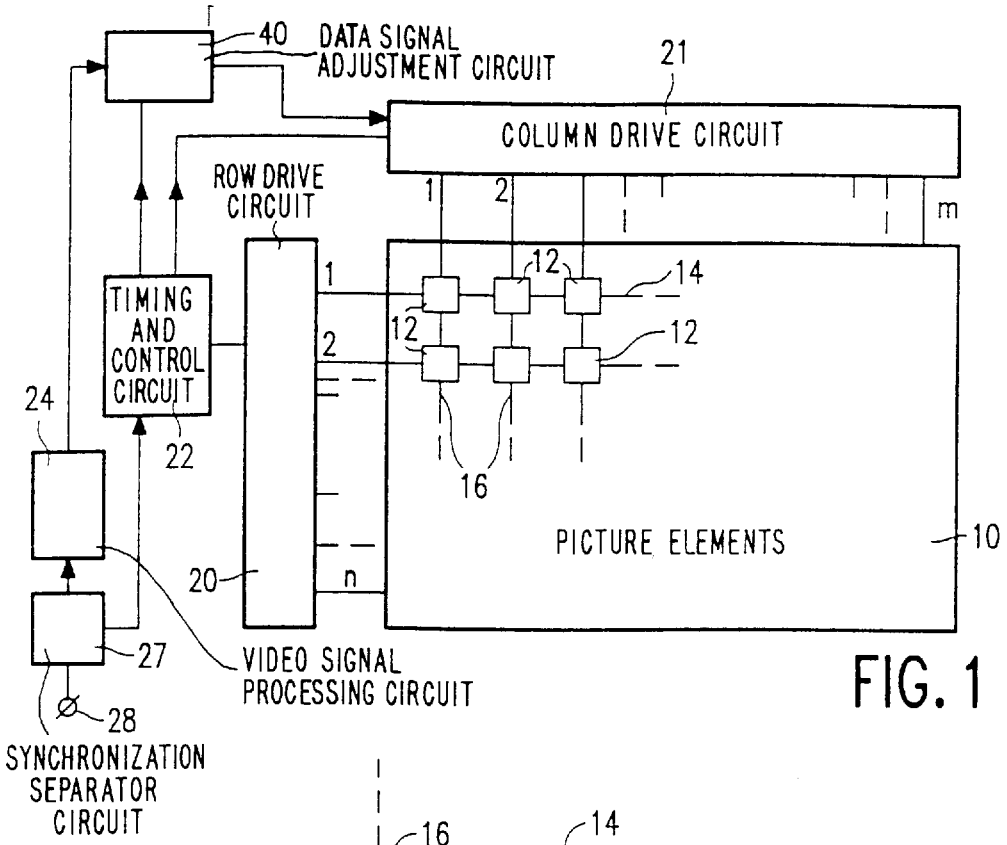
FIG. 1 is a simplified schematic block diagram of an active matrix display device according to the present invention.
Figure 2:
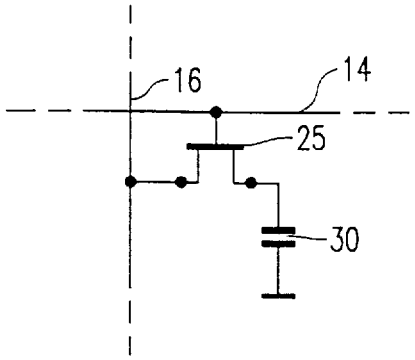
FIG. 2 illustrates the circuit of a typical picture element in a first embodiment of the display device.

Referring to FIG. 1, the active matrix display device, which is intended to display video, e.g. TV, pictures, or datagraphic information, includes a liquid crystal display panel 10 which has a row and column array, comprising n rows and m columns, of picture elements 12 each of which is located adjacent a respective intersection between sets of row and column address lines comprising conductors 14 and 16 to which drive signals are applied by row and column drive circuits 20 and 21. The panel 10 is of a known kind and of the type using TFTs as switching devices for the picture elements. FIG. 2 shows the circuit configuration of a typical picture element of the panel. The gate of the TFT, 25, is connected to a row address conductor 14 and its source and drain terminals are connected respectively to a column address conductor 16 and an electrode of a display element 30. The sets of conductors 14 and 16, the TFTs and the display element electrodes of the panel are all carried on a first transparent substrate of the panel, for example of glass, which is spaced from a second transparent substrate with liquid crystal material e.g. twisted nematic LC material, disposed between the substrates. Respective portions of a continuous transparent electrode carried on the second substrate constitute second electrodes of the display elements whereby each display element 30 consists of a pair of spaced electrodes with LC material sandwiched therebetween. All picture elements in the same row are connected to a respective one of the set of row address conductors 14 and all picture elements in the same column are connected to a respective one of the column address conductors 16. The substrates carry respectively on their outer and inner surfaces polarizing and LC orientation and protection layers respectively in conventional manner.

The row and column drive circuits 20 and 21 of the display device are each also of a conventional kind. The row drive circuit 20, for example a digital shift register circuit, repetitively scans the row conductors 14 and applies a selection signal to each row conductor during a respective row address period sequentially in turn. This operation is controlled by timing signals from a timing and control circuit 22 to which synchronization signals, derived by a synchronization separator circuit 27 from an incoming video, e.g. TV, signal applied to an input 28, are supplied. The column drive circuit 21 comprises one or more shift register/sample and hold circuits for which data, (video information) signals derived from the applied video signal are provided from a video signal processing circuit 24. The circuit 21 operates to sample these signals, under the control of the timing and control circuit 22 in synchronism with row scanning to provide serial to parallel conversion appropriate to the row at a time addressing of the panel. As each row line conductor 14 is scanned with a selection signal, the TFTs, 25, of the associated row of picture elements are turned on so as to charge the display elements 30 of the row to a desired display element voltage according to the level of the data signal then subsisting on their respective associated column line conductors 16, the display element voltage being proportional to the data signal voltage. Upon termination of the selection signal, the TFTs of the picture elements are turned off, thereby isolating the display elements from the column conductors until they are next addressed in the subsequent field period. Each row of picture elements of the panel is addressed in this manner so as to build up a display picture in a field period and the operation is repeated in successive field periods to produce a succession of display image fields. In the case, for example, of a TV display, each row of display elements is provided with picture information, data, of a TV line with the duration of selection signal corresponding to TV line period or less so that for a half resolution PAL standard TV display having a line period of 64 $\mu$s, each row address conductor is supplied with a selection signal at intervals of 20 ms.

To avoid electrochemical degradation of the LC material, the polarity of the drive signals is periodically inverted, for example after every field, (field inversion). Polarity inversion may also be carried out after every row or every two rows, commonly referred to as line (row) inversion and double line (row) inversion, in order to reduce flickering effects.

Figure 3:
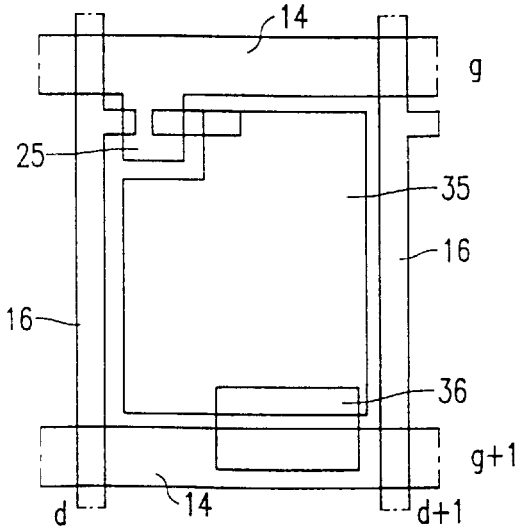
FIG. 3 shows schematically the physical layout of part of the picture element array in the first embodiment of the display device.
Figure 4:
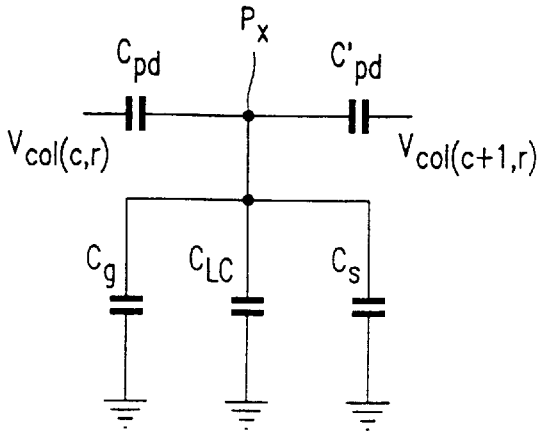
FIG. 4 is an equivalent circuit for a typical picture element in the first embodiment.

From the foregoing, it will be apparent that during operation each column address conductor 16 carries a voltage waveform which consists of a series of data signal voltage levels each of which is intended for a respective one of the picture elements in the column of picture elements connected to that column conductor. Ideally, every display element in a column will be accessed when its associated row conductor is selected and remain electrically isolated for the remainder of the display cycle. However, stray capacitances exist which couple the column conductor voltage waveforms to adjacent display elements and this coupling leads to cross-talk. The coupling affects the display element voltage and hence the transmission of unselected display elements. By increasing display resolution, the effects become worse since stray coupling capacitances become more significant. In a TFT type display device a primary source of unwanted coupling is the stray capacitance between column address conductors and display element electrodes. FIG. 3 illustrates schematically a typical physical layout for components on the active substrate of the display device. A display element electrode 35 is connected to the drain of the TFT 25 whose source is connected to a column address conductor 16, in this case conductor d, through which data signals are supplied to the electrode. This column conductor runs closely alongside one side of the electrode 35 and the column conductor for the adjacent column of picture elements, the d+1 column conductor, extends closely adjacent its opposite side. Row address conductors g and g+1 extend alongside the top and bottom edge respectively of the electrode. In this example picture element circuit, a storage capacitor 36 is included effectively in parallel with the display element. FIG. 4 is an equivalent circuit diagram showing the various capacitances present with this circuit configuration. Px indicates the display element electrode 35, $C_{LC}$, Cs and Cg denote respectively the display element capacitance, the storage capacitor capacitance and the total stray capacitance between the electrode 35 and the row conductors. Capacitive coupling of the data signals occurs via the parasitic capacitances Cpd and Cpd' between the display element electrode arid the two column conductors 16 between which the display element is located. Some coupling could result from the source/drain capacitance of the TFT, effectively in parallel with Cpd, but this is likely to be small in comparison. The column conductors d and d+1 carry the succession of data signals as a voltage waveform indicated in FIG. 4 by $V_{COL(c,r)}$ where c and r denote the column and row concerned.

Considering a display element in the xth row, then the voltages on column conductors d and d+1 for the associated display elements x+1 to n of the current field followed by the column voltages for display elements 1 to x−1 of the next display field will be coupled to the xth display element. In other words, after the addressing of the display element in the xth row, all the data voltage signals intended for the other n−1 display elements in the same column as that display element and for the other n−1 display element in the adjacent column which appear on the associated column conductors d and d+1 in the period, corresponding to a field period, before that display element is again addressed will be coupled. Thus, the coupled column voltages for any display element are the parts of the column waveforms which correspond to the column voltages for the next n−1 display elements in time. Because in practice the display device is operated with some kind of inversion (field, line, double line), then the coupled voltages will be affected by the change of polarity of the column signals.

To reduce cross-talk effects, the display device includes a data signal adjustment circuit 40 (FIG. 1), comprising a digital signal processing circuit, in its drive circuit that operates to adjust the supplied data signals, intended to produce desired outputs from the display elements, before they are applied to the column conductors in such a way as to compensate for the anticipated effects of this cross-talk so that, after the display elements have been driven using the adjusted data signals, the effect of the cross-talk is to cause the display elements to produce display outputs approaching those intended had there been no cross-talk. To this end, the value of an input data signal from the input video signal and intended for application to a picture element via a column conductor is adjusted having regard to the values of the input data signals from the video signal intended to be used for at least some of the other picture elements subsequently addressed via that column conductor and for the picture elements in an adjacent column addressed by the adjacent column conductor, (apart from the last column of the picture elements) up till the time the picture element is next addressed. The adjustment made to each data signal, in the form of a cross-talk compensation value which is derived from, and thus determined by, intended data signals for other picture elements connected to those column conductors, compensates for the likely effects on the display element voltage due to cross talk caused by the capacitive coupling.

The proportion of the column data signals which are coupled onto the display element from the column conductors d and d+1 (FIG. 3) respectively are given by the following equations:

$$F = \frac{Cpd}{C_{LC} + Cs + Cg + Cpd + Cpd'} \tag{1}$$

$$F' = \frac{Cpd'}{C_{LC} + Cs + Cg + Cpd + Cpd'} \tag{2}$$

These coupling factors F and F' become significant in high resolution display as display elements become smaller and parasitic capacitances increase relative to $C_{LC}$ and Cs.

The RMS display element voltage over one field period is given by the square root of the sum of the squares of the display element voltage over each line period divided by the number of video lines in the input signal, including blanking lines. Therefore, the following equation can be derived for the RMS voltage on a display element in column c, row r, situated between column conductor d and d+1 taking into account the capacitive coupling from the column conductors:

$$V_{pix_{(c,r)}}^{rms} = \sqrt{\frac{1}{N}\left[V_{col_{(c,r)}}^2 + \sum_{row=r+1}^{r+N-1}\left(V_{0_{(c,r)}} + F \cdot V_{col_{(c,row)}} + F' \cdot V_{col_{(c+1,row)}}\right)^2\right]} \tag{3}$$

where:

a) $V_{pix_{(c,r)}}{}^{rms}$ is the RMS display element voltage over one field period from the line period when display element (c,r) is selected until the line period immediately before display element (c,r) is selected again (inclusive).

b) $V_{col}$ is the value of the data signal which determines the display element voltage ($V_{pix}$) after addressing.

c) $V_{0(c,r)}=V_{col(c,r)}-F.V_{col(c,r)}-F'V_{col(c+1,r)}$ and c) N is the number of lines in the video field and $0 \leqq r \leqq (N-1)$.

Consequently the effect of field blanking is taken into account. It is to be noted that $V_{col}$ used here should include the contribution from the common electrode voltage.

The shift in the display element voltage from the intended value to a new one affects the transmission of the display element. Considering, for example, a display device operating in field inversion and where the polarity of the inversion signal is the same for all columns, and being used to display a central black square in a 30% transmission background, then the visible artifact of vertical cross-talk caused by column coupling will result in the display regions above and below that central black square having transmission levels different to that of the remainder of the background. Because the display device operates in field inversion the area directly above the black central square will appear darker since the coupled voltage will shift the display element of that region in the direction of black but the area directly below the square will appear lighter because the coupled voltages (from the next field now) will be of opposite polarity and therefore will shift the display element voltages of that region towards the other direction.

Such cross-talk is particularly noticeable on display devices operating in field inversion. Line inversion can reduce the problem up to a point but if the nature of the displayed picture is such that it tends to cancel the inversion pattern (for example black lines alternating with white lines) then cross-talk can again be highly visible. Patterns of this kind are commonly found on computer generated images. The above description relates to simple monochrome displays. Color display devices using the so-called delta-nabla color display element configuration will also suffer from cross-talk since the effects of row inversion in these display devices can similarly be cancelled in display pictures which contain blocks of primary colors.

Equation 3 can be expanded to give:

$$V_{pix_{(c,r)}}^{rms}=\left(V_{0_{(c,r)}}^{2}+\frac{F^2}{N}\Sigma V_{col_{(c,row)}}^{2}+\frac{F'^2}{N}\Sigma V_{col_{(c+1,row)}}^{2}+\frac{2\cdot F\cdot F'}{N}\cdot\Sigma V_{col_{(c,row)}}\cdot V_{col_{(c+1,row)}}+\frac{2\cdot F\cdot V_{0_{(c,r)}}}{N}\cdot\Sigma V_{col_{(c,row)}}+\frac{2\cdot F'\cdot V_{0_{(c,r)}}}{N}\cdot\Sigma V_{col_{(c+1,row)}}\right)^{0.5} \quad (4)$$

where all sums are from row=r+1 to row=r+N−1.

The column drive signals are dynamically modified in such a way as to cancel out the cross-talk by calculating the RMS voltage on a display element as described above and then eliminating the cross-talk, to a good approximation, by adjusting the data signal for each display element by an amount equal and opposite to the error voltage on each display element. The error voltage due to cross-talk is given by the difference between equation (3) and $V_{pix(c,r)}$. A correction which is equal and opposite to this error voltage is added to the data signal for display element (c,r) in order to obtain the desired final $V_{pix(c,r)}$ value. This correction voltage, $V_{cor}$ is given by:

$$V_{cor}=|V_{pix_{(c,r)}}|-V^{rms}{}_{pix_{(c,r)}} \quad (5)$$

Cross-talk is compensated in the display device by appropriately modifying the data signals for the display elements according to the equation:

$$V_{col'}=V_{col}+V_{cor} \quad (6)$$

where $V_{col'}$ is the adjusted data signal and applying this adjusted data signal to the column conductor. Then, after column couplings occur, the effects of such couplings will be substantially compensated and the voltage on the display element will be close to the one required so that the display output obtained from the display element approaches that intended. For example, if for a given display element a voltage of 5V rms is required, and, after applying the equation (3), it is found that the actual voltage will be 5.2V rms where the additional 0.2V rms is the coupled voltage due to column coupling of the data voltages for other display elements connected to the column conductors concerned then by applying around 4.8V initially instead to the display element, the effects of the column coupling can be largely negated and the actual rms display element voltage would be very close to the intended value of 5V. Of course, this compensation is not exact, bearing in mind that the compensation is derived from the originally intended data signals for the other display elements in the two columns before they too are adjusted. If those data signals are similarly compensated, the actual data signal levels applied to the column conductors will, of course, differ from those used in the computation of the adjusted data signal. Exact compensation would only be feasible for stationary images and periodic moving images. However, it has been found that the above described approach is highly successful and can eliminate, or at least significantly reduce, the visible effects of cross-talk.

Figure 5:
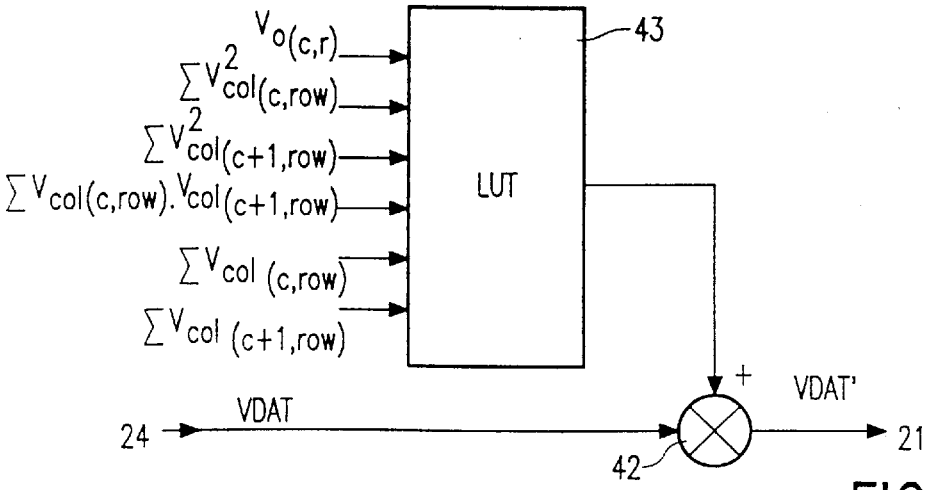
FIGS. 5 and 6 show diagrammatically the circuit configurations of parts of alternative forms of correction circuits used in a drive circuit of the first embodiment of display device.

Unlike some other known cross-talk correction methods, this approach works successfully with any kind of still or moving picture material, including the usually more difficult types of display patterns such as row on/row off patterns, and it imposes no extra timing requirements on the drive signals. As the cross-talk error voltage on a display element depends on data signals over the next field period, signal storage and processing is required. An individual cross-talk correction must be calculated for each display element by solving equations (4) and (5). To this end, the correction is calculated using a look-up table 43 (LUT) as shown in FIG. 5, in which VDAT is the input video data supplied in a digitized form from the video processing circuit 24, VDAT' is the output, corrected, video data and 42 is the correction adder. As is apparent, to solve the equations (4) and (5) it is necessary to know the value of a number of variables, including the display element voltage $V_{pix}$ for display element (c,r), the sums of the column voltages, $\Sigma V_{col}$, that will be applied to the columns c and c+1 over the next field period and the sums of the squares of those column voltages $\Sigma V^2{}_{col}$. Appropriate, fixed, values for N, F and F' are programmed into the LUT 43.

The calculation of the correction can be simplified to some extent. The first order F and F' terms dominate equation (4). If it is assumed that the higher order terms are negligible and that F=F'=F", then equation (4) can be simplified to:

$$V_{pix(c,r)}^{rms} = \left( V_{0(c,r)}^{2} + \frac{2 \cdot F'' \cdot V_{0(c,r)}}{N} \cdot \Sigma [V_{col(c,row)} + V_{col(c+1,row)}] \right)^{0.5} \quad (7)$$

Figure 6:
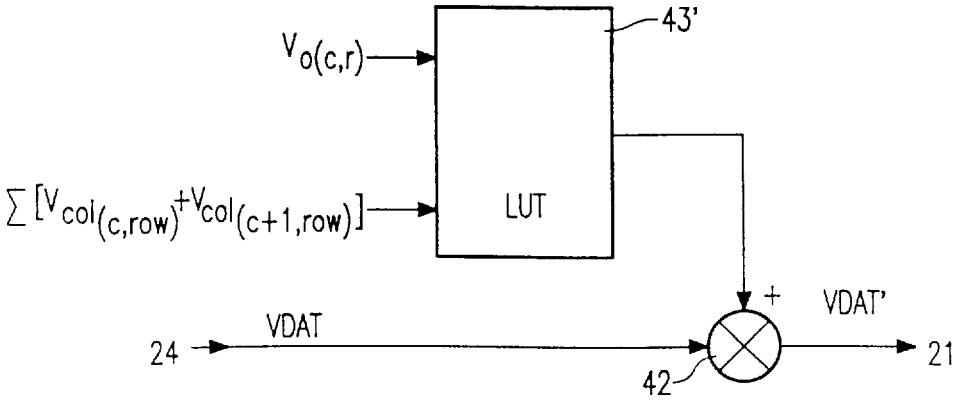

Correction based on this simplified equation will not be perfect but it will nevertheless still provide a useful reduction in the level of cross-talk effect. A correction based on equation (7) can be implemented using a LUT as shown in FIG. 6. As is seen, the LUT 43' requires fewer address lines in this case.

Figure 7:
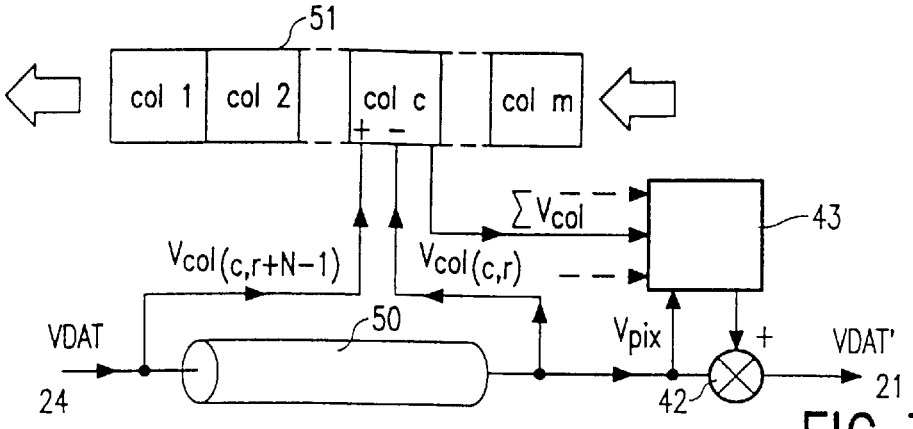
FIG. 7 illustrates schematically the operation of the correction circuit.

With regard to the arrangements of both FIG. 5 and FIG. 6, the sums, e.g $\Sigma V_{col}$ and $\Sigma V^2_{col}$, needed can be derived from running sums. The manner of such derivation can be generally as described in PCT WO96/16393 to which reference is invited for more detailed description, and with suitable modification to the circuit where appropriate. A brief explanation will be given, with reference to FIG. 7, with regard to the derivation of $\Sigma V_{col}$ for one column. The derivation of the $\Sigma V_{col}$ for the adjacent column is carried out in a similar manner. FIG. 7 is a schematic diagram illustrating a part of the data signal adjustment circuit 40, including the LUT 43 and the correction adder 42. Running sums are used to store the $\Sigma V_{col}$ value for each column. A linestore 51 contains the running sums for each column. Similarly, running sums are used to store the other required summations. These running sums are maintained in the following manner. The input video data signal, in digitized form, is fed into a field delay 50. This effectively is a rolling field store since a new row of display element values will enter when an old one is dropped out. Each time a data signal for a display element in column c enters the field delay the column voltage data for that display element is added to the column c sum. Each time a data signal for a column c display element emerges from the field delay the column voltage data for that display element is subtracted from the column c sum. Separate sums are maintained for all columns (1 to m) of the display array. In this way, by the time the video data for a given display element emerges from the field delay, the $\Sigma V_{col}$ for the next field period is ready to be used in the calculation of the cross-talk correction for that display element. The sum $\Sigma V_{col}^2$ and the sum $\Sigma V_{col(c,r)} \cdot V_{col(c+1,r)}$ are handled in a similar way except that the squared and multiplied values respectively of the data signals are generated using LUTs before being supplied to the linestore. The corrected data signals are supplied, via a D to A converter, to the column drive circuit 21 where they are sampled to provide serial to parallel conversion and supplied to the appropriate column conductors 16 to drive the picture elements.

The above technique requires a full resolution field delay. However, a different approach which is simpler than the dynamic correction scheme described above and which avoids the need for a field delay can be used. If the picture displayed is static then the column voltage one field period ahead will be the negative of the current column voltage, assuming field or line inversion drive is employed. Therefore, if the column voltages are summed from zero over one field period then the $\Sigma V_{col}$ can be updated as the data signal for each display element in the column arrives by using the current $V_{col}$ to predict the future $V_{col}$. Thus a running $\Sigma V_{col}$ prediction can be obtained without requiring a field delay. Of course, if the picture changes, this prediction becomes incorrect. The running sums, and hence the crosstalk corrections, will thus also become incorrect. Sudden changes between two images will imply that the corrections on 2 fields would be wrong but it is highly unlikely that this will be noticeable. The wrong correction will only be present for two field periods, (about 33 ms for a 60 Hz display). Complications arise when continuous motion is portrayed which implies continuous changes. Under these circumstances the "wrong" correction may become visible in the displayed image since it would be continuously present. To avoid this possibility the correction for a particular column is turned off depending on the data signal values at the end of each field period. The columns which have not changed significantly can have the correction applied to them during the next field while the ones which have changed significantly can be excluded from the correction. This kind of technique is also described in PCT WO96/16393 which reference is again invited for further details.

It will be appreciated from the foregoing that the cross-talk correction scheme described has a number of significant advantages. Cross-talk from, for example, row-on, row-off patterns, is eliminated, or at least substantially reduced. The full video line time remains available for display element addressing and charging. Further, the scheme does not require the column drive circuit data rate to be increased, or changes to be made to either the row or column driver ICs.

The invention is particularly important for display devices which have large coupling factors, especially small, high resolution TFT display devices. It can be used to similar benefit in other kinds of active matrix display devices, such as plasma-addressed liquid crystal display devices (PALC devices) which also involve large capacitive coupling factors. In a PALC display device, as for example described in EP-A-0628944 to which reference is invited, the rows of individual TFTs present in a TFT display device are replaced by plasma channels filled with an ionizable gas which run the length of the row. The plasma channels are separated from the LC layer by a thin sheet of glass called the microsheet. A row can be addressed by striking a plasma in the row's channel. This enables voltages applied via the column lines to be sampled and held on the display elements in the row.

Figure 8:
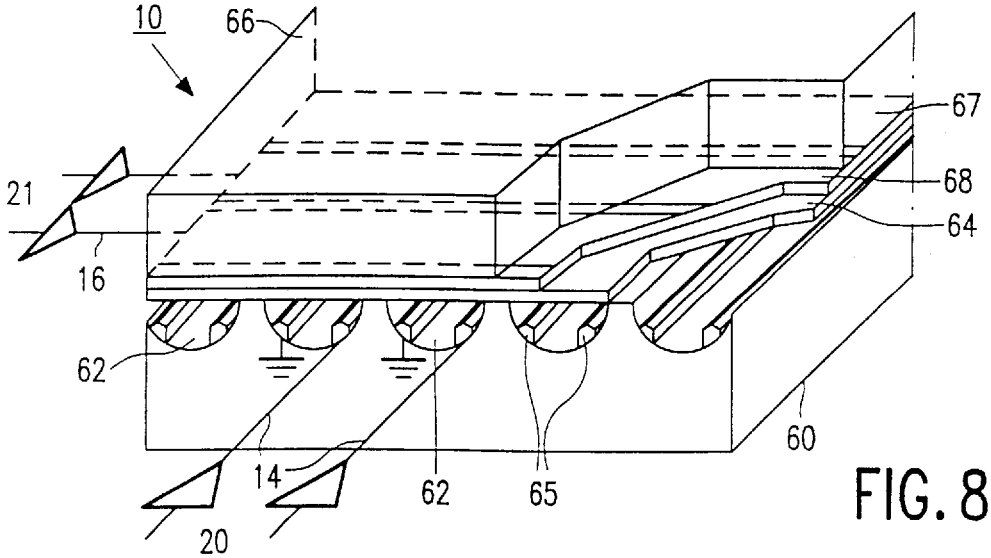
FIG. 8 shows schematically a cross-section through a part of a display panel in a second embodiment of the display device.

A schematic cross-section through part of a typical PALC display device is shown in FIG. 8. A lower glass substrate 60 is provided with a plurality of parallel, gas-containing, channels 62 extending in the row direction and along which electrodes 65 extend. The channels are covered by the microsheet 64 of dielectric material. A second glass substrate 66 carrying a set of parallel strips 67 of transparent conductive material, constituting the column lines 16, is spaced from the microsheet 64 and the intervening space filled with a layer 68 of LC material. At the regions where the strips 67 intersect the channels 62 respective picture elements are defined.

The cross-talk correction scheme described above can readily be applied to such a device, although the equations used to calculate the correction differ to an extent.

Figure 9:
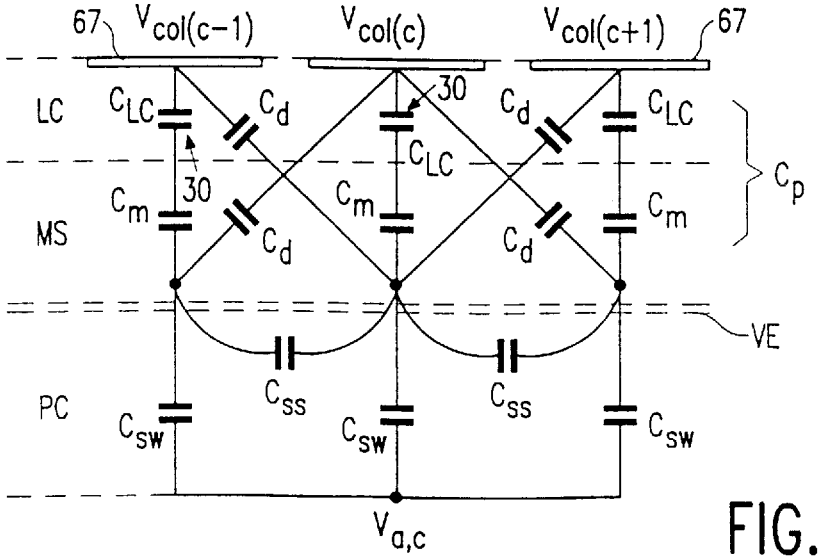
FIG. 9 illustrates the equivalent circuit of a typical group of picture elements in the second embodiment of display device.

An equivalent circuit of three horizontally adjacent PALC picture elements 12 when in the hold state (i.e. plasma off) is shown in FIG. 9. In this Figure, LC, MS and PC denote respectively the thicknesses of the LC layer 68, the microsheet 64, and the plasma channels, and VE denotes a virtual electrode. $C_{LC}$ is the capacitance of a single LC display element 30, $C_m$ is the microsheet capacitance, $C_{SW}$ is the off-state capacitance of the plasma channel from the backside of the microsheet to the anode and cathode electrodes. Va,c is the voltage at which the anode and cathode electrodes 65 are held during the hold period. $C_{SS}$ is the side-to-side capacitance between the horizontally adjacent virtual electrodes on the backside of the microsheet. $C_d$ is the capacitance between diagonally opposite electrodes through the LC layer and the microsheet.

The microsheet appears as a small capacitance $C_m$ in series with the LC capacitance $C_{LC}$. Therefore any voltages applied to the column lines 16 are divided between $C_m$ and $C_{LC}$. The net effect is that the useful voltage which appears across $C_{LC}$ is only a fraction ($1/\alpha$) of the applied column voltage. This means the peak-to-peak column voltage range $V_{col_pp}$ must be increased by a factor of $\alpha$ to achieve the required range of voltages on the LC display element $C_{LC}$. Therefore a large $C_m$ (thin microsheet) is desirable as, firstly, it reduces the required $V_{col_pp}$ and, secondly, it reduces the unwanted capacitive coupling factors by increasing the total picture element capacitance $C_p$. It is to be noted, however, that the increased $V_{col_pp}$ does not directly affect the error voltage on $C_{LC}$ due to unwanted capacitive coupling because the coupled voltages are also attenuated by $\alpha$.

For a given display size and resolution, unwanted capacitive coupling effects will be more significant on PALC display devices than on TFT display devices. There are a number of reasons for this. The microsheet capacitance reduces the overall display element capacitance which increases the column coupling factors and makes crosstalk worse. The side-to-side coupling capacitances are more significant in the PALC display device structure. In a TFT display, a display element in the hold situation is influenced by the voltages on columns c and c+1 only. In a PALC display device a column c display element in the hold situation is influenced by the voltages on columns c−1, c and c+1. In certain circumstances the voltages coupled from these three columns can add so as to produce a large error voltage. There are two main kinds of cross-talk effects caused by unwanted capacitive couplings in PALC display devices. The first is known as column kickback, sometimes also called data diffusion. This effect leads to a reduction in display contrast and is caused by capacitive coupling onto a given display element in a column of the transitions in voltage on the associated column line and the adjacent two column lines which occur immediately after the display element has been selected. This particular kind of cross-talk effect can be overcome to an extent by suitably emphasizing the difference in magnitude between data signals supplied to mutually adjacent column lines. The second kind of cross-talk effect, which is of concern here, is vertical cross-talk, sometimes also known as "front to back cross-talk". This produces a shading effect which is visible above and below extended blocks of color and certain alternating dot patterns. The effect is caused by the unwanted capacitive coupling of voltages from column lines c−1, c and c+1 onto unselected display elements in column c. This effect can be corrected using a scheme similar to that in the TFT display device embodiment described previously.

The following equation can be used to calculate the RMS voltage on the LC display element capacitance ($C_{LC}$) of a display element in row r of column c, over one field period, taking into account the effect of unwanted capacitive coupling from column lines c−1, c and c+1:

$$V^{rms}_{LC_{(c,r)}} = \sqrt{\frac{1}{N}\left[V^2_{LC_{(c,r)}} + \sum_{row=r+1}^{r+N-1}\left(V_{0_{(c,r)}} + \frac{F}{\alpha}V_{col_{(c,row)}} - \frac{F'}{\alpha}\left(V_{col_{(c-1,row)}} + V_{col_{(c+1,row)}}\right)\right)^2\right]} \quad (8)$$

where:

$V^{rms}_{LC_{(c,r)}}$ is the RMS display element (c,r) voltage over one field period: from the line period lo display element (c, r) is selected until the line period before display element (c,r) is selected again (inclusive).

$V_{LC(c,r)}$ is the initial voltage which is set when the display element is selected. $V_{O(c,r)}=V_{LC(c,r)}-FV_{col(c,r)}+F'(V_{col(c-1,r)}+V_{col(c+1,r)})$. This gives the voltage on the display element after column kickback has occurred.

$V_{col(c,r)}$ is the column voltage applied to column line c when row r is selected. $1/\alpha=C_m/(C_m+C_{LC})$. This is the fraction of the total voltage across $C_{LC}$ and $C_m$ which appears across $C_{LC}$.

F is the coupling factor between column line c and the display element (c,r) F' is the coupling factor between column line c−1 or c+1 and the display element (c,r).

N=the total number of lines in the video field and $0 \leqq r \leqq N-1$. The voltages applied during the field blanking period are included in this calculation.

Figure 10:
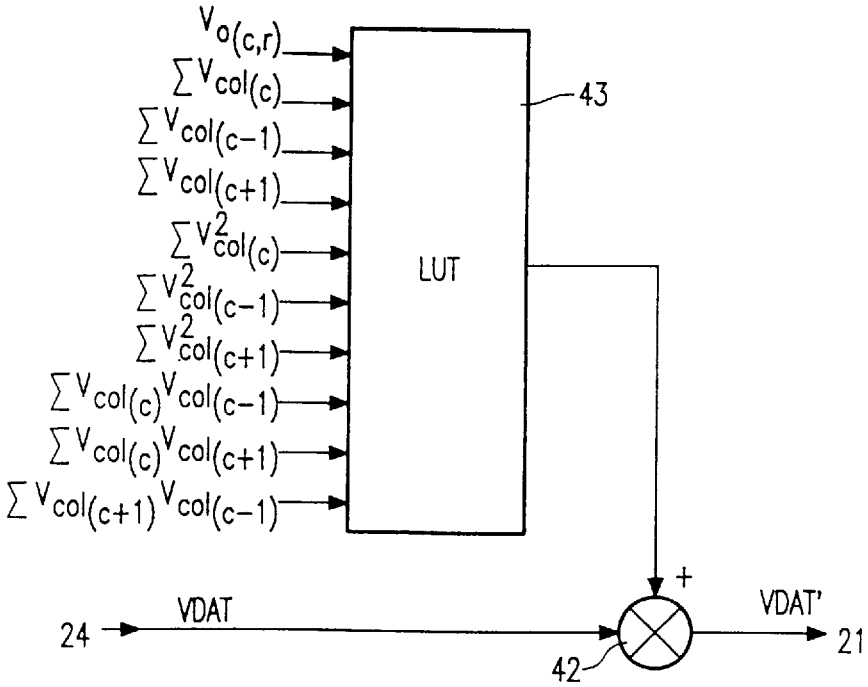
FIGS. 10 and 11 show diagrammatically the circuit configurations of parts of alternative forms of correction circuits used in a drive circuit of the second embodiment of the display device.

Equation (8) can be expanded to give:

$$V^{rms}_{LC_{c,r}} \cong \left(V_0^2 + \frac{2F}{Na}V_0\Sigma V_{col_{(c,row)}} - \frac{2F'}{Na}V_0\Sigma V_{col_{(c-1,row)}} - \frac{2F'}{Na}V_0\Sigma V_{col_{(c+1,row)}} + \frac{F^2}{Na^2}\Sigma V^2_{col_{(c,row)}} + \frac{F'^2}{Na^2}\Sigma V_{col_{(c-1,row)}} + \frac{F'^2}{Na^2}\Sigma V^2_{col_{(c+1,row)}} - \frac{2FF'}{Na^2}\Sigma V_{col_{(c,row)}}V_{col_{(c-1,row)}} - \frac{2FF'}{Na^2}\Sigma V_{col_{(c,row)}}V_{col_{c+1,row)}} + \frac{2F'^2}{Na^2}\Sigma V_{col_{(c-1,row)}}V_{col_{(c+1,row)}}\right)^{0.5} \quad (9)$$

where all sums are from row=r+1 to row=r+N−1. The error voltage due to vertical crosstalk is given by Error=Equation (9)−$V_{0(c,r)}$. This error can be eliminated if a correction which is equal and opposite to the error is added to the display element voltage $V_0$ (after any adjustment for column kickback effects). This correction can be calculated using a lookup table as shown in FIG. 10, for comparison with the arrangement for TFT display devices shown in FIG. 5. As before, the input video data VDAT, in digitized form, is supplied to the correction adder 42 together with the cross-talk correction value from the look-up table 43 to obtain the output, corrected, video data VDAT'.

The number of bits used to represent each variable should be minimized in order to reduce the size of the look-up table. Another way in which the correction hardware may be simplified is as follows.

If $V_{col(c-1,row)}=V_{col(c,row)}=V_{col(c+1,row)}$ for all values of "row", the signals on adjacent column lines are in phase and equation (8) can be rewritten as:

$$V^{rms}_{LC_{c,r}} \cong \sqrt{V_0^2 + \frac{2F''}{Na}V_0\Sigma V_{col_{(c,row)}} + \frac{F''^2}{Na^2}\Sigma V^2_{col_{(c,row)}}} \quad (10)$$

where F"=F−2F'. Under these circumstances the error voltage due to vertical cross-talk is at a minimum.

Similarly, when $-V_{col(c-1,row)}=V_{col(c,row)}=-V_{col(c+1,row)}$ for all values of "row", the signals on adjacent column lines are out of phase and equation (8) can be written as equation (10) but with F'=F+2F'. In this case the error voltage due to vertical cross-talk is at a maximum.

For any given picture, there exists a value of F" which will allow an accurate $V_{LCrms}$ to be calculated using equation (10). This value of F" will lie somewhere between the two extremes of F"=F−2F' and F"=F+2F'. A good approximation of the ideal F" value for a display element at position (c,r) in a given field can be obtained by comparing the sum of the column voltages that will be applied to adjacent columns over the forthcoming field period (or the preceding field period in the case of the static vertical cross-talk correction scheme). Assuming the display is driven in single row inversion mode the following equation applies:

$$\sum_{\text{row}=r+1}^{r+N-1} V_{coco_{(c,r)}} = \left| \sum_{\text{odd rows}} V_{col_{(c-1,row)}} - \sum_{\text{odd rows}} V_{col_{c,row)}} \right| + \left| \sum_{\text{even rows}} V_{col_{(c-1,row)}} - \sum_{\text{even rows}} V_{col_{(c,row)}} \right| + \left| \sum_{\text{odd rows}} V_{col_{(c+1,row)}} - \sum_{\text{odd rows}} V_{col_{(c,row)}} \right| + \left| \sum_{\text{even rows}} V_{col_{(c+1,row)}} - \sum_{\text{even rows}} V_{col_{(c,row)}} \right| \quad (11)$$

where $\Sigma V_{coco}$ is the "column-on column-off" or "COCO" figure for column c at the time display element (c,r) is selected. When $\Sigma V_{coco}=0$ it can be assumed that the signals on adjacent columns are in phase and F"=F−2F'. When $\Sigma V_{coco}$ is at its maximum value it can be assumed that the signals on adjacent columns are out of phase and F"=F+2F'. A linear interpolation can be used to determine the best value of F" to use when $\Sigma V_{coco}$ has some intermediate value.

Figure 11:
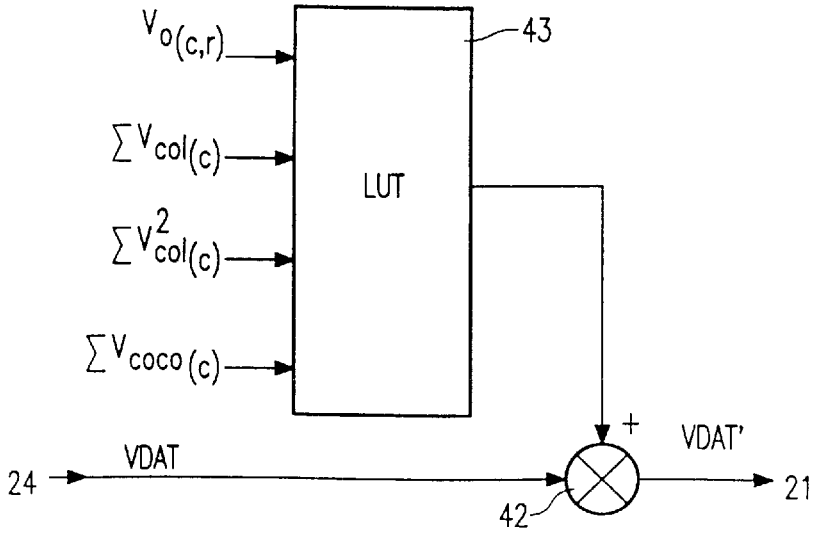

Therefore, equations (10) and (11) can be used to calculate the RMS voltage with a much smaller look-up table as shown in FIG. 11. $\Sigma V_{coco}$, $\Sigma V_{col}$ and $\Sigma V^2_{col}$ can be derived from running sums as described in PCT WO96/16393.

As well as display devices using TFTs and PALC display devices, the invention can be applied also to matrix display devices using two-terminal non-linear switching devices. In these display devices, the switching device, such as a thin film diode device, TFD, for example a MIM, is connected in series with a display element between a row address conductor and a column address conductor and sets of row and column address conductors are carried on respective, spaced, substrates between which LC material is disposed. In one form, the row address conductors are provided as a set of strip electrodes carried on one substrate and the set of column conductors are carried on the other substrate together with a row and column array of display element electrodes and the TFDs, with each TFD being connected between a display element electrode and an associated column conductor and with the column conductors extending vertically in gaps between adjacent columns of display element electrodes. Consequently, capacitive coupling then may exist between a display element electrode and the column address conductor associated with an adjacent column of display elements producing an error signal on the display element. In an alternative form, the display element electrodes are carried on the same substrate as the set of row conductors and the TFDs with each display element electrode being connected to an associated row conductor via a TFD and with the row conductors extending horizontally in gaps between adjacent rows of display element electrodes. The set of column conductors is carried on the other substrate and provided as a set of strip electrodes each of which overlies a respective column of display element electrodes. In this case, error signals could be coupled indirectly to a display element electrode from a column conductor adjacent that associated with the display element via an intermediate capacitance formed by the display element electrode and a display element electrode in an adjacent column.

In both forms, the data signal adjustment circuit above can be used to reduce the extent of unwanted cross-talk effects due to such couplings.

In the above-described embodiments, the adjustment effected for each picture element is based on the data signal levels for all other picture elements in the relevant columns. The nature of the circuits 40 in both embodiments and their manner of operation makes this reasonably straightforward to achieve. However, using, for example, alternative kinds of adjustment circuits, it is possible that the adjustment of the data signal voltage for a picture element may be accomplished using less than all the data signals which are intended to be applied to the column conductors in the period following addressing the picture element and its next addressing. Using the data signals for a proportion of the other picture elements would possibly provide less reduction in cross-talk but nevertheless could give results which are acceptable and adequate in certain situations.

In deriving the adjustment to the data signal, account may be taken also of the effects of leakage currents in the TFTs or TFDs, for example due to their inherent behavior or their photosensitive properties, or row kick-back effects, as described in PCT/WO96/16393, when generating the correction values in the circuit 40 used to adjust the data signals.

Whilst the effects of the data signals on the column conductor associated with a display element and on the adjacent column conductor or conductors associated with one or both immediately adjacent columns of display elements are the most important, it will be appreciated that further couplings, either direct or indirect, may exist leading to unwanted cross-talk effects due to data signals on column conductors further away, i.e column conductors not immediately adjacent the display element concerned. Whilst the effects of these further couplings are likely to be much less significant, account could be taken of them in the derivation of the adjusted data signal in the circuit 40 if desired.

In summary, therefore, an active matrix display device has been disclosed which has an array of LC display elements, with associated switching means, addressed in row sequential fashion via sets of row and column address lines includes in its drive circuit a data signal adjustment circuit which adjusts data signals before application to the column lines so as to compensate for anticipated effects of vertical and lateral forms of cross-talk due to stray capacitive couplings in the picture element array. A corrective value for a picture element data signal is derived in the adjustment circuit according to the values of data signals intended over a subsequent field period for other picture elements in the same column and one, or both, adjacent columns and relevant capacitive coupling factors.

From reading the present disclosure, other modifications will be apparent to persons skilled in the art. Such modifications may involve other features which are already known in the in the field of crystal display devices and which to features already described herein.

I claim:

1. An active matrix display device having a row and column array of picture elements comprising rows of liquid crystal display elements with switching means coupled thereto, sets of row and column address lines coupled to the rows and columns of picture elements respectively, and a drive circuit for applying data signals to the column address lines and for scanning the row address lines to select each row of picture elements in sequence so as to drive the display elements of a selected row in accordance with the data signals applied to their associated column address lines, which is characterised in that the drive circuit includes a data signal adjustment circuit for adjusting input data signals prior to their application to the column address lines according to a cross-talk compensation value and supplying the adjusted data signals to the column address lines for use in driving the display elements so as to compensate for cross-talk effects due to stray capacitive couplings with the display elements, and in which the adjustment circuit is arranged to derive the cross-talk compensation value for a picture element from the data signals intended to be applied in the period until that picture element is next selected to the column address line associated with the column of picture elements in which that picture element lies and to at least one of the column address lines associated with the adjacent columns of picture elements.

2. An active matrix display device according to claim 1, characterised in that the data signal adjustment circuit determines the compensation value for an input data signal for a picture element according to the values of said input data signals intended for at least some of the other picture elements coupled to its associated column address line and at least one of the adjacent column address lines and capacitive coupling factors for the picture element whose values are dependent at least on the stray capacitances between the display element and those column address lines.

3. An active matrix display device according to claim 1, characterised in that the data signal adjustment circuit is arranged to derive a cross-talk compensation value for a picture element data signal from the data signals intended for substantially all the other picture elements in the same column and substantially all the picture elements in at least one of the adjacent columns.

4. An active matrix display device according to claim 1, characterised in that the data signal adjustment circuit includes a store in which input data signals are held for a field period and from which data signals are read out and adjusted according to the crosstalk compensation value which is determined from the values of the input data signals for picture elements in the said columns that are held in the store during that field period.

5. An active matrix display device according to claim 1, characterised in that the data signal adjustment circuit adjusts an input data signal according to a cross-talk compensation value which is derived from the values of data signals input during the immediately preceding field period.

6. An active matrix display device according to claim 5, characterised in that the data signal adjustment circuit is arranged to disable the adjustment of input data signals for a column of picture elements in the event that values determined by the input data signals for the column differ by a predetermined amount in consecutive field periods so that the input data signals for the column are supplied to the picture elements of that column without adjustment.

7. An active matrix display device according to claim 1, characterised in that the switching means comprise thin film transistors and in that the cross-talk compensation value is derived according to the data signals intended for picture elements in the same column as the picture element concerned and the picture elements in the adjacent column whose associated column address line extends alongside that picture element.

8. An active matrix display device according to claim 1, characterised in that the display device is a plasma-addressed display device in which the switching means comprise plasma channels, and in that the cross-talk compensation value for a picture element is derived according to the data signals intended for picture elements in the same column as the picture element concerned and the picture elements in the adjacent columns to either side of that column.

* * * * *